US006204236B1

(12) United States Patent
Herrmann et al.

(10) Patent No.: US 6,204,236 B1
(45) Date of Patent: Mar. 20, 2001

(54) ENZYME GRANULATES COMPRISING AN ENZYME AND AN ORGANIC DISULFIDE CORE

(75) Inventors: Hubert A. Herrmann, Cremlingen-Weddel; Rolf Spannagl, Husum; Günther Richter, Hannover, all of (DE)

(73) Assignee: Genencor International, Inc., Palo Alto, CA (US)

( * ) Notice: Subject to any disclaimer, the term of this patent is extended or adjusted under 35 U.S.C. 154(b) by 0 days.

(21) Appl. No.: 09/180,121

(22) PCT Filed: May 30, 1997

(86) PCT No.: PCT/US97/09082

§ 371 Date: Mar. 31, 1999

§ 102(e) Date: Mar. 31, 1999

(87) PCT Pub. No.: WO97/46658

PCT Pub. Date: Dec. 11, 1997

(30) Foreign Application Priority Data

Jun. 1, 1996 (DE) ..... 196 22 131

(51) Int. Cl.[7] ..... C11O 3/386

(52) U.S. Cl. ..... 510/392; 510/224; 510/226; 510/370; 510/323; 510/334; 510/349; 510/360; 510/441; 510/473; 510/497; 510/499

(58) Field of Search ..... 510/226, 392, 510/224, 320, 323, 334, 349, 360, 441, 473, 477, 499

(56) References Cited

U.S. PATENT DOCUMENTS

| | | | | |
|---|---|---|---|---|
| 3,352,695 | | 11/1967 | Iaciofano et al. | 106/5 |
| 3,503,883 | | 3/1970 | Ford et al. | 252/89 |
| 3,627,683 | * | 12/1971 | Adam et al. | 252/89 |
| 4,940,665 | * | 7/1990 | Iijima et al. | 435/187 |
| 4,973,417 | * | 11/1990 | Falholt | 252/95 |
| 5,318,714 | * | 6/1994 | Markussen et al. | 252/95 |
| 5,858,952 | * | 1/1999 | Izawa et al. | 510/392 |

FOREIGN PATENT DOCUMENTS

| | | |
|---|---|---|
| 0 185 528 A2 | 6/1986 | (EP) . |
| WO 96/37596 | 11/1996 | (WO) . |
| WO 96/41860 | 12/1996 | (WO) . |

OTHER PUBLICATIONS

Copy of Supplementary European Search Report for EP 97 92 7810.8.

* cited by examiner

*Primary Examiner*—Kery A. Fries
(74) *Attorney, Agent, or Firm*—Genencor International, Inc.

(57) ABSTRACT

New enzyme granulates are described which contain an organic disulfide compound (R—S—S—R), particularly they contain the free amino acid cystine, optionally mixed with the amino acid cysteine. The new enzyme granulates are for us in detergent and cleanser compositions, particularly in dishwasher compositions, and they have properties. For example, insofar as protecting objects made of silver against tarnishing, for example, dishes, cutlery, and other objects to be cleaned.

25 Claims, No Drawings

ENZYME GRANULATES COMPRISING AN ENZYME AND AN ORGANIC DISULFIDE CORE

DESCRIPTION

The present invention concerns new enzyme granulates which contain an organic disulfide compound, a method for the production of the new enzyme granulates as well as their use in detergent, cleanser, bleach and dishwasher compositions.

In many detergent and cleanser compositions, for example, for cleaning textiles or dishes, enzymes are used to increase detergent or cleaning effectiveness. Usually the enzymes used are proteases, lipases, amylases or cellulases; the enzymes can here be used as individual enzymes or as enzyme mixtures. The enzymes are added to powdered or granular detergent and cleanser formulations in the form of so-called enzyme granulates, which contain the enzyme or enzyme mixture in question together with a filler, binder, and optionally, additional granulation and formulation auxiliaries. Such enzyme granulates are usually prepared by processing an enzyme concentrate with filler and binder, and optionally, the additional granulation and formulation auxiliaries to form a composition which is then granulated. The resulting moist granulate particles are, if desired, rounded, and then dried. Optionally the dried granulate particles are then coated with a protective lacquer and they can then be used in powdered or granulated detergent and cleanser formulations.

The problem therefore consisted in making available new enzyme granulates which contain, besides the usual granulate components, an additional formulation component which has an advantageous effect on the properties of the enzyme granulate itself and also in the application formulations; the prepared enzyme granulates should be particularly suitable for use in powdered or granulated detergent and cleanser formulations, preferably in dishwasher formulations.

Enzyme granulates have now been found which present the required properties, and which are indicated in the claims 1–12. The object of the invention therefore is an enzyme granulate consisting of a core, which contains at least one enzyme and, in addition, water-soluble and/or water-insoluble fillers, binders, humectants as well as, optionally, additional granulation or formulation auxiliaries and, optionally, enzyme stabilizers, and, optionally, of one or more protective layers which surround the core, where the enzyme granulate is characterized in that the core contains an organic disulfide compound ($R_1$—S—S—$R_2$), preferably the free amino acid cystine, which can, optionally, be in the form of a cystine/cysteine mixture.

An advantageous enzyme granulate of the invention is characterized in that the content of organic disulfide compound in the core, preferably the amino acid cystine, is up to 20 wt % with respect to the enzyme granulate as 100 wt % (dry weight without humidity). Preferably, the content of organic disulfide compound, in the enzyme granulate in the core, particularly the amino acid cystine, is up to 15 wt % with respect to the enzyme granulate as 100 wt % (dry weight without humidity).

In an advantageous enzyme granulate according to the invention the core in particular, the following composition, with respect to the enzyme granulate as 100 wt % (dry weight without humidity): 0.8–20 wt % of enzyme or enzyme mixture (enzyme protein content), 40–90 wt % of water-soluble and/or water-insoluble fillers, 5–15 wt % of binders, 0.2–5 wt % humectants, 3–20 wt % of organic disulfide compound, preferably the amino acid cystine, and, optionally, up to 10 wt % of additional standard granulation or formulation auxiliaries and, optionally, up to 5 wt % of enzyme stabilizers.

In a preferred embodiment of the enzyme granulate according to the invention, the core has a content, with respect to the enzyme granulate as 100 wt % (dry weight without humidity) of 1–10 wt % enzyme or enzyme mixture (enzyme protein content), 60–85 wt % water-soluble and/or water-insoluble fillers, 10–15 wt % binders, 0.2–2 wt % humectants, 5–15 wt % of an organic disulfide compound, preferably the amino acid cystine, and optionally, up to 10 wt % of additional standard granulation or formulation auxiliaries, and optionally, up to 5 wt % of enzyme stabilizers.

The enzyme granulates according to the invention are characterized by their advantageous content of the organic disulfide compound $R_1$—S—S—$R_2$. The disulfide group —S—S— can here bear organic residues $R_1$ and $R_2$, where these residues, particularly alkyl residues, can be identical or different or they can combine with the disulfide group —S—S— to form a ring, and where, optionally, these residues, particularly alkyl residues, can also be substituted with amino groups, carboxy groups (in acid form or in salt form, particularly with alkali metals) or hydroxy groups. Examples of residues $R_1$ and $R_2$ are, for example, the 2-hydroxyethyl residue, the 1-carboxy-2-hydroxyethan-2-yl residue and the 1-carboxy-2-aminopropan-3-yl residue, and $R_1$ and $R_2$ together for $R_1$—S—S—$R_2$ as a ring, the 2,3-butanediol-1,4-diyl residue. Suitable organic disulfide compounds thus are, for example, 2,2'-dithiodiethanol, 2,2'-dithiodiglycolic acid and, in particular 3,3'-dithiobis(2-aminopropionic acid), also the amino acid cystine, as well as the cyclic disulfide of 1,4-dimercapto-2,3-butanediol (dithiothreitol, dithioerythritol), where the cyclic dimer can, optionally, also be in the form of a mixture with the open dimer and/or the monomer for 1,4-dimercapto-2,3-butanediol. The content of the preferred amino acid cystine here can also be in the form of a cystine/cysteine mixture, because cysteine (HS—$CH_2$—CH ($NH_2$)—COOH, 2-amino-3-mercaptopropionic acid) is readily oxidized to cystine in a neutral or alkaline aqueous solution. The weight ratio of cystine to cysteine here can vary in this variant of the invention in a broad range, in particular, within the context of the invention, in the range from 90:1 to 1:1. The preceding weight ratio applies, by analogy, to mixtures of the cyclic disulfide of 1,4-dimercapto-2,3-butanediol with the open dimer or monomer.

The enzyme granulate according to the invention can contain water-insoluble or water-soluble fillers, which in themselves are standard, either alone or in the usual mixtures with each other. The water-insoluble filler is here selected in particular from the group of cellulose, zeolith or silicate, for example, layered silicate, grain flour, legume or malvaceae flour and/or starch.

The water-insoluble filler mixture contained in advantageous enzyme granulates according to the invention consists of a mixture of cellulose and at least one zeolith or silicate, particularly layered silicate, where, in a preferred embodiment, grain flour and/or starch constitute, optionally, additional components of the water-insoluble filler mixture. Grain flour and starch can here be either used alone or in a mixture with each other. As grain flours it is possible to use any of the flours which in themselves are known, made of wheat, rye, barley, oats, rice or corn. It is preferred to use wheat flour. In an additional preferred variant of the invention, legume or malvaceae flours are used as water-insoluble fillers or as components of water-insoluble filler mixtures. The source of the flour for this variant of the invention consists of legume fruits. Legumes are defined as plant foods (pods) that belong to the vegetable fruits. Therefore, sources for legume flours comprise the fruit of legume species such as Pisum (peas), Cajamus (pigeon pea), Cicer (chick-pea); Lens (lentils); Phaseolus (beans), Vigna (cowpeas), Dolchius Chyacinth beans, Cassavalia sword beans, Vicia (horsebeans or vetch); Peluschken [translation unknown]; Arachis (peanuts); lupines; alfalfa; soybeans as well as lima beans and optionally other pods and also malvaceae fruit (for example, the genus Gossipium, cotton). It is particularly preferred to use peas and particularly soybeans. Legume flours or flours made from the fruit of the family malvaceae are particularly advantageous as the auxiliary for the production of enzyme granulates according to the invention, because, when they are used as carriers and fillers, and also when used as additional formulation component besides other standard carriers and fillers, they develop a positive effect on the enzyme stability of both individual enzymes and also enzyme mixtures, and on the dust properties of enzyme granulates prepared therewith; furthermore, these flours permit a simpler, enzyme-considerate and, compared to other standard carriers or fillers, more economical production of enzyme granulates. For the preparation of the legume or malvaceae flour it is possible to use, among the oil-containing fruit of the above-mentioned examples, fruit from which all the oil has been removed, some of the oil has been removed, as well as oil-containing fruit; for this purpose it is preferred to use fruit from which a part or all the oil has been removed, particularly, legume fruit from which a part of the oil or all the oil has been removed, for example, soybeans which have to a large extent been freed of their oil content. The oil removal can be carried out here in a manner which in itself is standard. It is preferred for the enzyme granulate to contain, therefore, as water-insoluble filler, a mixture of cellulose, at least one zeolith or silicate, particularly a layered silicate, and optionally at least one grain flour and/or legume or malvaceae flour.

The cellulose component in the water-insoluble filler mixture consists of fibrous cellulose, for example, fibrous cellulose in the range of 20–50 $\mu$m. Especially preferred is fibrous cellulose with a mean fiber length of approximately 30 $\mu$m, which has been proven suitable. As additional components, the water-insoluble filler mixture contains zeoliths or silicates, particularly layered silicates such as bentonite or kaolin or layered silicate mixtures of kaolin and bentonite. Kaolin can optionally also be in a mixture with calcium carbonate and/or bentonite.

The water-soluble filler in the enzyme granulate according to the invention can be an alkali chloride, an alkali acetate, an alkali sulfate, calcium carbonate, a sugar such as, for example, lactose, or a mixture thereof. If, optionally, sugars are used as water-soluble fillers in the enzyme granulates according to the invention, then it is advantageous to use monosaccharides such as glucose or disaccharides such as lactose and/or maltose or polysaccharides such as dextrin. Also suitable are mixtures of sugars such as, for example, glucose syrup. It is preferred to use disaccharides, particularly lactose and/or maltose as the sugar component in the filler in the enzyme granulates according to the invention. Advantageously, the above-mentioned sugars are used in the enzyme granulates according to the invention in a quantity of 0.5–10 wt %, particularly 1.0–5.0 wt %, with respect to the total solid content of the enzyme granulate. As water-soluble filler mixtures it is advantageous to use inorganic water-soluble salts such as, for example, alkali chlorides, alkali acetates, alkali sulfates or mixtures thereof in the enzyme granulates according to the invention. It is preferred to use alkali sulfates, particularly sodium sulfate.

The enzyme granulate according to the invention can also contain binders or binder mixtures which in themselves are standard. It is preferred for the enzyme granulate of the invention to contain, as binder, polyethylene glycol with molecular weights in the range of 200–10,000, a polyvinylpyrrolidone with molecular weights in the range of 12,000–3,000,000, starch and/or wheat gluten; if polyvinylpyrrolidone are used as binder, their preferred molecular weights are in the range 1,300,000–2,800,000. The binders can be used either alone or in combination with each other.

An embodiment of the enzyme granulate according to the invention contains, with respect to the finished enzyme granulate (as 100 wt %, dry weight) at least 0.2 wt % of a humectant. As a humectant it is possible to consider using surfactants which in themselves are standard and tolerant of enzymes, optionally also in combination, particularly nonionic surfactants and mild ionic surfactants. In an advantageous embodiment of the invention, the humectant is a nonionic surfactant from the group of ethoxylated alcohols with 5–85 ethoxy groups, for example, dodecyl alcohol ethoxylated with 80 ethoxy groups, or a surfactant from the group of sulfosuccinic acid esters. The quantity of the humectant or of a humectant combination should not exceed 5 wt % of the enzyme granulate. Advantageous enzyme granulates in particular have a humectant content of 0.2–3 wt %, preferably 0.2–2 wt %.

The enzymes in the enzyme granulate can be the usual enzymes which are known in themselves and used for detergent and cleanser applications, either alone or in a compatible combination with each other. For the enzyme granulates according to the invention, it is thus possible to use any of the standard enzymes for detergent and cleanser compositions, such as, for example, proteases, lipases, amylases, glucanases such as, for example, cellulases, hemicellulases, pullulanases, or oxidoreductases, lysozyme. The enzymes can be contained in the enzyme granulates according to the invention alone or as enzyme mixtures, for example, as protease/amylase mixtures or protease/lipase mixtures. Advantageous enzyme granulates of the invention contain, as enzymes, a protease, amylase, cellulase, hemicellulase, lipase, oxidoreductase, lysozyme or any mixture thereof. Commercial examples include Optitherm® (thermostable $\alpha$-amylase), Optimase® (alkaline protease of the BPN' [expansion unknown] type), Opticlean® (highly alkaline protease of the subtilisin 309 type) from the company Solvay Enzymes GmbH & Co. KG (Nienburg, Del.). In the context of the present invention it is also possible to use enzymes that have been altered by genetic engineering, for example, optimized by mutation.

In a preferred embodiment, the enzyme granulates according to the invention contain a thermostable $\alpha$-amylase and/or an alkaline or highly alkaline protease. In this context it is particularly advantageous to use proteases for incorporation in the enzyme granulates according to the invention which have improved properties due to chemical and/or genetic-engineering modification, such as an increased detergent performance or improved stability. Here the so-called subtilisins are particularly advantageous as alkaline proteases. Subtilisins are alkaline proteases with a pH optimum in the alkaline pH range and an essential serine residue in the active center. They can be extracted, in a manner which in itself is known, from Gram positive bacteria or from fungi. Here it is preferred to use subtilisins extracted from Bacillus strains, for example, subtilisins such as subtilisin BPN', Carlsberg subtilisin, and subtilisins which can be isolated from *Bacillus subtilis, Bacillus amyloliquefaciens, Bacillus licheniformis, Bacillus lentus, Bacillus mesentericus* or *Bacillus alcalophilus*. It is particularly preferred to use subtilisins which have a pH optimum in the range from 7–13 and which are commercially available, for example, as Savinase®, Maxacal®, Durazym®, Maxapem or Opticlean®.

The enzymes that are suitable for the enzyme granulates according to the invention can be obtained, in a manner which in itself is known, by fermentation processes from appropriate microorganisms, particularly from bacteria or fungi. The ferment broths obtained in the fermentation are freed of insoluble accompanying substances, for example, by filtration, and then they are reduced in a manner which in itself is known, for example, using a membrane filtration process such as micro- and/or ultrafiltration with, optionally, subsequent dialysis and/or thin-layer evaporation. In this manner, so-called enzyme concentrates are obtained, which usually contain the enzyme or enzyme mixture in a quantity of 2–50 wt % with respect to the dry substance, in addition to possibly other accompanying substances that have not been separated. If desired, these liquid enzyme concentrates can be further transformed, for example, by spray drying and/or freeze drying, into dry enzyme concentrates.

The enzyme granulates according to the invention can, in each case with respect to the total solid content, have, for example, a composition which is such that the water-insoluble filler mixture consists of 15–40 wt % cellulose, 5–18 wt % kaolin, if desired in a mixture with 1–35 wt % bentonite and 1–13 wt % calcium carbonate. optionally it is possible to use, as additional water-insoluble fillers, 0–10 wt % grain flour and/or legume flour and/or 0–50 wt % starch. Usually 0.5–20 wt % sodium sulfate is used as water-soluble filler. In addition, up to 30 wt % binder from the group of polyethylene glycol and polyvinylpyrrolidone can be used in the content. The enzyme can be incorporated as enzyme concentrate in a quantity of up to 40 wt % in the enzyme granulates according to the invention. To stabilize the enzymes, the granulates can contain 0.5–15 wt % alkali formiate or alkaline-earth formiate and, optionally, 0.5–20 wt % sugar, in particular reducing disaccharides such as lactose, as already described above as water-soluble filler.

In an advantageous embodiment, an enzyme granulate according to the invention contains, in the core, in each case with respect to the total solid content (without moisture content), 0.8–20 wt % enzyme or enzyme mixture (enzyme protein), 4–26 wt % cellulose, 5–25 wt % grain flour and/or legume flour, optionally 0–20 wt % starch, 0–20 wt % kaolin, 0–10 wt % calcium carbonate, 0–10 wt % sodium sulfate, 5–15 wt % polyethylene glycol (molecular weight 3000), 1–5 wt % lactose, 6–20 wt % bentonite, 0.2–5 wtt humectant and a total of 3–20 wt % the organic disulfide compound, preferably cystine or a cystine/cysteine mixture.

Naturally the enzyme granulates according to the invention can contain, besides the above-mentioned main components, additional granulation auxiliaries such as, for example, lubricants or dispersants. Possible lubricants that can be used include a glycerol monoester with long-chain fatty acids, and an example of a dispersant is a sulfosuccinic acid ester with long-chain fatty alcohols in concentrations of up to 10 wt %.

In addition, the invention comprises a method for the production of enzyme granulates, in which an extrudable mass that was prepared by mixing an enzyme preparation with water, fillers, binders, and optionally, additional components, can be extruded to particles, followed by rounding the particles produced in a rounding apparatus, subsequent drying of the rounded particles, and optionally, coating of the particles with a protective layer, with addition to the extrudable mass of the organic disulfide compound, preferably the amino acid cystine or a cystine/cysteine mixture, in a quantity of up to 20 wt %, particularly in a quantity of 0.5–20 wt %, with respect to the total solid matter content of the enzyme granulate.

In the method according to the invention, it is possible to use liquid enzyme concentrates as enzyme preparations, where the enzyme concentrates are prepared in a manner which in itself is known by the fermentation of microorganisms and the processing of the ferment broth produced by the fermentation. In the sense of the invention, enzyme preparations are defined to include solid enzyme concentrates which can be prepared, for example, by freeze-drying liquid enzyme concentrates.

Advantageously, the method is carried out in such a manner that the enzyme concentrate is added to a preprepared dried premix of the remaining powdered recipe components in an appropriate mixing apparatus, for example, a conical mixer or a plowshare mixer. Then water is added in an amount which is metered in such a way that a mass is formed which is easily shaped and extruded. Usually the moisture content of this mixture is 20–50 wt %. The extrudable mass obtained in this manner is mixed in the mixture until it is homogeneous, and then it is led into an extruder. In the extruder the mass is extruded by means of a perforated disk having perforation diameters of 0.4–3 mm, preferably 0.6 mm, to form strands, which are then rounded in a rounding apparatus, for example, a rotary disc apparatus, to spherical particles. After the rounding the particle, which is still moist, is dried in a dryer, for example, a fluidized bed dryer, at a temperature of 30–50° C. up to a residual moisture content of 10–2 wt %. If desired, the enzyme granulates obtained can be coated during and/or after this process step with a protective lacquer, in order to protect, in this manner, the enzyme granulate particles from external influences, for example, or to cover any color the particle may have of itself, or to change the particle's color. To obtain enzyme granulates with a light color, the enzyme granulates can be coated, for example, with a titanium dioxide-containing dispersion in a manner which in itself is known. For this purpose it is possible to disperse titanium dioxide with polyethylene glycol as binder in water in a known manner, and to inject it through nozzles into the drying installation.

According to the method of the invention, enzyme granulates are obtained which consist, to a large extent, of rounded dust-free particles having a diameter of 0.2–1.0 mm and a bulk density of 600–1100 g/L, and which are advantageously suited as components of powdered or granular detergents and cleansers.

Another object of the invention consists of the use of the enzyme granulates according to the invention in powdered or granular detergents and cleansers, bleaches or dishwasher formulations, advantageously in bleach-containing dishwasher formulations. Such detergents and cleansers can, for example, be used for the cleaning of surfaces, for example, to remove fat residues in the hygiene or food sectors. The enzyme granulates according to the invention are preferably used in detergent and cleanser formulations for cleaning textiles or dishes. In addition to the enzyme granulates, detergent and cleanser formulations here can contain all the standard detergent components used in the state of the art, such as surfactants, bleaches or builders, as well as other standard auxiliaries for the formulation of powdered detergent and cleansers, in quantities which in themselves are standard. The auxiliaries include, for example, reinforcers, enzyme stabilizers, dirt carriers and/or compatibilization agents, complexers and chelators, foam regulators and additives such as optical brighteners, opacification agents, corrosion inhibitors, antielectrostatics, dyes, bactericides, bleaches, activators, peracid bleach precursors. They can contain, besides the enzyme granulates according to the invention, bleach or bleach mixtures based on peracid compounds, for example, perborate, such as sodium perborate tetrahydrate, sodium perborate monohydrate or sodium percarbonate, in quantities which in themselves are standard in the detergent or dishwasher compositions.

By the incorporation of the organic disulfide compound, particularly cystine or cystine/cysteine mixture, in the granulates according to the invention, the enzymes are stabilized, particularly the heat stable α-amylase or the so-called proteases, in a surprising manner. Thus the enzyme granulates according to the invention present very good properties, which are particularly well suited for using powdered detergent and cleanser formulations. In powdered formulations, particularly in bleach-containing or oxidizing formulations, they present a good storage stability, and consequently they are particularly well suited for oxidation agent-containing formulations as well, such as, for example, peroxide-containing formulations. Because the enzyme granulates according to the invention prevent a markedly low dust and enzyme dust content, they have very good processability. An additional advantage consists in that larger enzyme losses can be avoided during the production of the enzyme granulates according to the invention. In addition, the enzyme granulates according to the invention present excellent dissolution properties during the washing or cleaning process. Thus, already within 2 min, more than 90% of the enzyme is released from the enzyme granulates according to the invention into the detergent solution, so that during the washing or cleaning process, a very long action time of the enzyme on the corresponding cleaning object, for example, dishes or cutlery, is guaranteed. In addition, the enzyme granulates according to the invention, in dishwasher compositions, have a particularly good effect in protecting objects made of silver or objects coated with silver, for example, dishes, cutlery and other objects to be cleaned, from tarnishing, because of their content of organic disulfide compound, particularly cystine or a cystine/cysteine mixture.

The following examples should further explain the invention, without, however, limiting its scope.

EXAMPLES

Example 1

Production of an enzyme granulate with thermostable α-amylase.

The recipe components listed in the example recipes indicated below, are mixed in a rapid mixer of the Lodige type together with the liquid enzyme concentrate to form an extrudable mass.

The extrusion is carried out in a double-worm extruder of the Fuji-Paudal EXDCS60 type through a perforated metal sheet with a perforation diameter of 600 μm.

The extrudate was then rounded in a Marumizer type Fuji-Paudal Q400 and then dried in a fluidized bed dryer of the Glatt GPCGS type to Brown marumes [unconfirmed translation].

The lacquering of the Brown marumes with a pigment-containing lacquer was carried out in a fluidized bed coater of the Glatt GPCG3 type.

Recipe of the unlacquered granulate L-cystine USP manufactured by the company Freedom Chemical Diamalt GmbH was used, with the following particle size distribution:

| <50 μm | 50–100 μm | >100–180 μm | >180–250 μm | >250 μm |
|---|---|---|---|---|
| 4.5% | 9.4% | 49% | 36% | 1.6% |

The liquid enzyme concentrate used consisted of the following components:

4 wt % enzyme protein (thermostable α-amylase, activity 840,000 MWU/g), 40 wt % of the standard production-determined accompanying substances, 1 wt % of the standard preservatives, and 55 wt % water; pH 6.0.

MWU=modified Wohlgemuth unit; what is measured is the quantity of enzyme which degrades, under the test conditions, 1 mg of soluble starch within 30 min to a dextrin of defined size.

Recipe of the granulate:

The granulate recipes (without enzyme) have the following composition (indications in parts by weight):

| | Test No. | | | | | |
|---|---|---|---|---|---|---|
| | 1a | 1b | 1c | 1d | 1e | Comparison |
| Enzyme | Thermostable α-amylase | | | | | |
| Water-insoluble Fillers: | | | | | | |
| Cellulose | 23.8 | 21.7 | 19.5 | 17.4 | 13 | 26 |
| Kaolin | 11.9 | 10.8 | 9.8 | 8.7 | 0.5 | 13 |
| Calcium Carbonate | 7 | 7 | 7 | 7 | 7 | 7 |
| Wheat Flour | 26 | 26 | 26 | 26 | 26 | 26 |
| Water-insoluble Fillers: | | | | | | |
| Sodium Sulfate | 10 | 10 | 10 | 10 | 10 | 10 |
| Lactose | 5 | 5 | 5 | 5 | 5 | 5 |
| Binder | | | | | | |
| PEG 3000 | 12 | 12 | 12 | 12 | 12 | 12 |
| PVP K-90 | 1 | 1 | 1 | 1 | 1 | 1 |
| Humectant | 0.3 | 0.3 | 0.3 | 0.3 | 0.3 | 0.3 |
| Cystine | 3.2 | 6.5 | 9.7 | 13 | 19.5 | 0 |

Recipe of the coating:

For the coating, a lacquer having the following recipe was used:

| | |
|---|---|
| Water | 550 L |
| PEG 4000 | 87.5 kg |
| PEG 200 | 10 L |
| Calcium carbonate | 100 kg |
| Titanium dioxide | 200 kg |

PEG = polyethylene glycol

Result:

The finished granulate had the following properites:

| | Test No. | | | | | |
|---|---|---|---|---|---|---|
| | 1a | 1b | 1c | 1d | 1e | Comparison |
| Cystine proportion in the total granulate | 2.5 Gew % | 5 Gew % | 75 Gew % | 10 Gew % | 15 Gew % | 0% |
| Bulk density (g/l) | 695 | 681 | 686 | 710 | 732 | 635 |
| Oversize particle Brown marumes 1 mm | 0 | 0 | 0 | 0 | 0 | 0 |
| Oversize particle and product >1 mm | 0 | 0 | 0 | 0 | 0 | 0 |
| Activity (1000) MWU/g) | 248 | 246 | 254 | 255 | 260 | 234 |
| Heubach total dust content (mg/20 g) | 24 | 33 | 18 | 33 | 11 | 40 |
| Heubach enzyme dust (mg/20 g) | 4.4 | 9.6 | 3.8 | 7.9 | 2.2 | 13 |
| Solubility 95% in min* | — | <1 | <1 | <1 | <1 | <1 |
| Solubility 100% in min* | — | 2 | 3 | 1 | 2 | 5 |

*1 g granulate in 200 mL buffer solution (pH 5.4); temperature 25° C.

| Test No. Enzyme | 2a Comparison Optimase | | 2b Comparison Opticlean | |
|---|---|---|---|---|
| Water-soluble Fillers: | | | | |
| Cellulose | 23.8 | 26.7 | 23.5 | 27.0 |
| Kaolin | 7.1 | 9 | 6 | 6.9 |
| Calcium Carbonate | 8.9 | 10 | 8.6 | 9.8 |
| Bentonite | 21 | 22.6 | 15.7 | 17.6 |
| Wheat Flour | — | — | 7.9 | 7.9 |
| Water-soluble Fillers: | | | | |
| Sodium Sulfate | 4.5 | 4.5 | 6.9 | 6.9 |
| Lactose | 5 | 5 | 7.9 | 7.9 |
| Maltodextrin | 5 | 5 | — | — |
| Binder | | | | |
| PEG 3000 | 12.2 | 12.2 | 11.8 | 11.8 |
| PVP K-90 | 1.5 | 1.5 | 1.2 | 1.2 |
| Humectant | 1 | 1 | 0.5 | 0.5 |
| Calcium formiate | 2.5 | 2.5 | 2.5 | 2.5 |
| Cystine | 7.5 | — | 7.5 | — |

The enzyme concentrate, and as much water as the powdered premix in the conical mixture required to produce a homogenous extrudable mass, were added. The moisture content of this moist mixture was approximately 30 wt %.

The homogenous moist mixture obtained was transferred into an extruder. Through a perforated matrix with perforation diameters of approximately 0.6 mm, the mass was extruded to strands. The broken strand sections obtained were transferred into a rotary disc apparatus. where they were shaped into rounded particles during a processing time of approximately 20 sec. The rounded particles were then dried in a fluidized bed dryer at a temperature of approximately 48° C. to a water content of approximately 5 wt %.

The granulate obtained consisted of rounded particles with diameters of 0.2–1.0 mm. The granulate was nonadhesive and it was readily pourable with a bulk density of approximately 800 g/L. Additional properties are indicated in the following table. Properties of the granulate:

| Sample | Optimase Standard | Optimase with 6 wt % cystine | Opticlean Standard | Opticlean with 6 wt % cystine |
|---|---|---|---|---|
| Oversize particle Brown marumes >1 mm | 0 | 0 | 0 | 0 |

-continued

| Sample | Optimase Standard | Optimase with 6 wt % cystine | Opticlean Standard | Opticlean with 6 wt % cystine |
|---|---|---|---|---|
| Activity (DU/g) | 658000 | 654000 | 1030000 | 1080000 |
| Heubach total dust (mg/20 g) | 14 | 24 | 7.4 | 9.3 |
| Heubach enzyme dust content (mg/20 g) | 11 | 21 | 7.0 | 13 |
| Solubility 95% in min* | 8 | 5 | 5 | 5 |
| Solubility 100% in min* | 10 | 8 | 8 | 8 |

*1 g granulate in 200 mL buffer solution (pH 5.4); temperature 25° C.

The good processability (extrudability and formability) of the standard samples was not negatively affected. The solubility is not affected in the case of the use of Opticlean as protease of cystine, and, in contrast, if Optimase is used as the protease, the solubility is improved.

Any reference to enzyme activities in the present application refers to activity determinations for the given enzyme that are based on standard methods that are known to themselves and familiar to persons skilled in the art.

What is claimed is:

1. An enzyme granulate comprising, a core having a composition of, (i) 0.8–20 wt % enzyme protein content, (ii) 40–90 wt % water-soluble fillers, water-insoluble fillers or mixtures thereof, (iii) 5–15 wt % of one or more binders, (iv) 0.2–5 wt % of one or more humectants, and (v) 3–20 wt % of an organic disulfide compound, with respect to the enzyme granulate as 100 wt %.

2. The enzyme granulate of claim 1 further comprising, a core having a composition of (vi) up to 10 wt % of granulation or formulation auxiliaries or mixtures thereof, and (vii) up to 5 wt % of enzyme stabilizers.

3. The enzyme granulate of claim 1, wherein the water-insoluble filler is selected from the group consisting of cellulose, zeoliths, silicates, grain flours, legume flours, Malvaceae flours and starch, and the water-soluble filler is selected from the group consisting of alkali chloride, alkali acetate, alkali sulfate, calcium carbonate, glucose, lactose, maltose and dextrin.

4. The enzyme granulate of claim 1, wherein the organic disulfide compound is selected from the group consisting of 2, 2'-dithiodiethanol; 2, 2'-dithiodiglycolic acid; 3, 3'-dithiobis(2-aminopropionic acid); cystine; cystine/ cysteine mixtures; and the cyclic disulfide of 1,4-dimercapto-2, 3-butanediol, including mixtures of the open dimer and monomers thereof.

5. The enzyme granulate of claim 1, wherein the organic disulfide compound is cystine or a cystine/cysteine mixture and the weight ratio of cystine to cysteine is in the range from 90:1 to 1:1.

6. The enzyme granulate of claim 1 further comprising, one or more protective layers surrounding the core.

7. The enzyme granulate of claim 1, wherein the organic disulfide compound in the core is 5–15 wt %.

8. A formulation comprising the enzyme granulate of claim 1.

9. The formulation of claim 8, wherein said formulation is used for objects made of silver or silver-coated objects.

10. The formulation of claim 8, wherein said formulation is a bleach-containing dishwashing formulation.

11. An enzyme granulate comprising, a core having a composition of, (i) one or more enzymes, (ii) a water-soluble filler, water-insoluble filler or mixtures thereof, and (iii) an organic disulfide compound of the formula $R_1$—S—S—$R_2$ wherein $R_1$ and $R_2$ are alkyl or alkyl substituted with amino, metal, carboxy, or hydroxy groups or mixtures thereof, and wherein $R_1$ and $R_2$ may be identical, different or combined with the disulfide group S—S to form a ring.

12. The enzyme granulate of claim 11 further comprising, one or more protective layers surrounding the core.

13. The enzyme granulate of claim 11 further comprising, a core having a composition of, (iv) one or more binders, and (v) one or more humectants.

14. An enzyme granulate comprising, a core having a composition of, (i) 0.8–20 wt % enzyme protein content, (ii) 40–90 wt % water-soluble filler, water-insoluble filler or mixtures thereof, (iii) 5–15 wt % of one or more binders, (iv) 0.2–5 wt % of one or more humectants, and (v) 3–20 wt % of an organic disulfide compound with respect to the enzyme granulate as 100 wt %, and wherein said disulfide compound is in the form of the free amino acid cystine or in the form of a cystine/cysteine mixture.

15. The enzyme granulate of claim 14, wherein the core has the composition of, (i) 1–10 wt % enzyme protein content, (ii) 60–85 wt % water-soluble filler, water-insoluble filler or mixtures thereof, (iii) 10–15 wt % of one or more binders, (iv) 0.2–3 wt % of one or more humectants, and (v) 5–15 wt % of an organic disulfide compound.

16. The enzyme granulate of claim 14 further comprising, a core having a composition of (vi) up to 10 wt % of granulation or formulation auxiliaries or mixtures thereof, and (vii) up to 5 wt % of enzyme stabilizers.

17. The enzyme granulate of claim 14, wherein the organic disulfide compound is in the form of the free amino acid cystine.

18. The enzyme granulate of claim 14, wherein the organic disulfide compound is in the form of a cystine/cysteine mixture.

19. The enzyme granulate of claim 14, wherein the water-insoluble filler is selected from the group consisting of cellulose, zeoliths, silicates, grain flours, legume flours, Malvaceae flours and starch, and the water-soluble filler is selected from the group consisting of alkali chloride, alkali acetate, alkali sulfate, calcium carbonate, glucose, lactose maltose and dextrin.

20. The enzyme granulate of claim 14, wherein the binder is selected from the group consisting of polyethylene glycols with molecular weights of 200–1,000, polyvinylpyrrolidones with molecular weights of 12,000–3,000,000, starch and wheat gluten.

21. The enzyme granulate of claim 14, wherein the humectant is a non-iongenic surfactant or a surfactant from the group of sulfosuccinic acid esters.

22. The enzyme granulate of claim 14, wherein the enzyme protein is selected from the group consisting of proteases, amylases, cellulases, hemicellulases, lipases, oxidoreductases, lysozymes and mixtures thereof.

23. The enzyme granulate of claim 22, wherein said enzyme protein is a protease, amylase or mixture thereof.

24. The enzyme granulate of claim 14 further comprising, one or more protective layers surrounding the core.

25. A formulation comprising the enzyme granulate of claim 14 wherein said formulation is a detergent, cleaning, bleaching or dishwashing formulation.

* * * * *